US009493333B2

(12) United States Patent
Biesheuvel

(10) Patent No.: US 9,493,333 B2
(45) Date of Patent: Nov. 15, 2016

(54) DISPENSING APPARATUS AND METHOD FOR COOLED DISPENSING OF A FLUID

(75) Inventor: Arend Cornelis Jacobus Biesheuvel, Werkendam (NL)

(73) Assignee: Koninklijke Douwe Egberts B.V., Utrecht (NL)

( * ) Notice: Subject to any disclaimer, the term of this patent is extended or adjusted under 35 U.S.C. 154(b) by 704 days.

(21) Appl. No.: 12/596,403

(22) PCT Filed: Apr. 17, 2008

(86) PCT No.: PCT/NL2008/050223

§ 371 (c)(1),
(2), (4) Date: Jan. 4, 2010

(87) PCT Pub. No.: WO2008/127113

PCT Pub. Date: Oct. 23, 2008

(65) Prior Publication Data

US 2010/0127017 A1 May 27, 2010

(30) Foreign Application Priority Data

Apr. 17, 2007 (NL) ..... 1033704

(51) Int. Cl.

| | |
|---|---|
| ***B67D 7/80*** | (2010.01) |
| ***F25B 29/00*** | (2006.01) |
| ***B67D 1/08*** | (2006.01) |
| ***B67D 3/00*** | (2006.01) |

(52) U.S. Cl.

CPC ..... *B67D 1/0858* (2013.01); *B67D 1/0895* (2013.01); *B67D 3/0009* (2013.01); *B67D 3/0022* (2013.01); *B67D 2210/00118* (2013.01)

(58) Field of Classification Search

CPC B67D 1/0858; B67D 1/0895; B67D 3/0022; B67D 3/0009; B67D 2210/00118

USPC ..... 222/52, 54, 146.1; 165/253; 62/3.64, 62/389

See application file for complete search history.

(56) References Cited

U.S. PATENT DOCUMENTS

| | | | | |
|---|---|---|---|---|
| 4,129,178 | A * | 12/1978 | Hucke | 165/61 |
| 4,913,318 | A | 4/1990 | Forrester | |
| 4,915,261 | A * | 4/1990 | Strenger | 222/92 |
| 5,212,954 | A | 5/1993 | Black et al. | |
| 5,560,211 | A * | 10/1996 | Parker | 62/3.63 |
| 6,418,730 | B1 * | 7/2002 | Tremblay et al. | 62/3.64 |
| 7,681,761 | B2 * | 3/2010 | Harra | A23G 9/20 222/135 |
| 2005/0072852 | A1 * | 4/2005 | An | F25D 23/126 236/91 R |

FOREIGN PATENT DOCUMENTS

| | | |
|---|---|---|
| WO | WO 00/14008 A1 | 3/2000 |
| WO | WO 02/081360 A1 | 10/2002 |
| WO | WO 2008/127113 A2 | 10/2008 |

OTHER PUBLICATIONS

International Search Report for International Patent Application No. PCT/NL2008/050223, mailed Nov. 5, 2008, 3 pages.

* cited by examiner

*Primary Examiner* — J. Casimer Jacyna
(74) *Attorney, Agent, or Firm* — Foley & Lardner LLP

(57) ABSTRACT

A dispensing apparatus for cooled fluid, provided with a fluid holder, a cooling system near the fluid holder for cooling fluid in the fluid holder, a tap for dispensing fluid from the fluid holder, and means for active heating of fluid in said fluid holder in order to prevent the temperature of said fluid from dropping below a reference temperature.

14 Claims, 3 Drawing Sheets

DISPENSING APPARATUS AND METHOD FOR COOLED DISPENSING OF A FLUID

CROSS-REFERENCE TO RELATED APPLICATIONS

The present application claims priority as a national stage application of International Patent Application No. PCT/NL2008/050223 filed on Apr. 17, 2008; which claimed priority to The Netherlands Application No. NL1033704 filed on Apr. 17, 2007, both of which are hereby incorporated herein by reference.

BACKGROUND

The invention relates to a dispensing apparatus for cooled fluid, provided with a fluid holder, a cooling system near the fluid holder for cooling fluid in the fluid holder and a tap for dispensing fluid from the fluid holder.

In addition, the invention relates to a method for cooled dispensing of a fluid to be drawn, wherein a cooling system is provided.

Dispensing apparatuses for cooled fluid are known from, for instance, facilities for dispensing cool drinking water. When the main power supply of such an apparatus is activated, the cooling system is switched on and the compressor will build up pressure in the cooling circuit so that the coolant circulates in order to cool a buffer of water. While the main power supply on the dispensing apparatus remains activated, the compressor is intermediately switched off. This prevents freezing of the water and, hence, damage to the dispensing apparatus. After having been intermediately switched off, the respective compressor is also switched on again, for instance under the influence of a temperature control, for actively keeping the water cool, wherein each time, some time elapses before the required pressure in the circuit is built up by the compressor.

Known, relatively large drinking water cooling systems keep water in buffers at a temperature for a longer period of time, for instance during office hours or even half or entire days. To this end, the compressor is switched on and off so that the water is held within a particular temperature range. A drawback of these apparatuses is that here, during relatively long periods of time, relatively much energy is consumed. Another drawback is that relatively large water buffers and/or large compressors, for instance HBP (High Back Pressure) compressors are used. As a result, known drinking water facilities often occupy much space.

SUMMARY

The object of the invention is, inter alia, solving at least one of the above-mentioned drawbacks.

This object and/or other objects can be achieved with a dispensing apparatus for cooled fluid, provided with a fluid holder, a cooling system near the fluid holder for cooling fluid in the fluid holder, a tap for dispensing fluid from the fluid holder, and means for active heating of this cooled fluid in the fluid holder in order to prevent the temperature of the fluid from dropping below a reference temperature.

As with a dispensing apparatus for cooled fluid according to the invention means for active heating are deployed when the fluid threatens to drop below a particular reference temperature, the fluid holder can be prevented from becoming colder than desired. In particular freezing of the fluid can be prevented. When the temperature of the fluid threatens to drop below a particular reference temperature, the means for active heating can be switched on, so that at least the local temperature of the fluid remains equal or rises and does not drop below the reference temperature, for instance below freezing. Although the cooling system and the means for active heating will compensate for each other, and therefore much energy appears to be needlessly consumed, the combination of a cooling system with heating means brings a lot of surprising advantages.

As the compressor keeps running continuously after a main power supply signal has been switched on, and the means for active heating can be deployed for preventing, for instance, local freezing of the fluid, the compressor needs not be switched off and no intermediate pressure build-up or pressure cut back within the cooling system takes place. Also, the relatively large pressure difference in the cooling circuit of the pressure in front of and the pressure after the valves, that is formed after shut down of the compressor needs not be equalized and/or no relatively heavy (HBP) compressors need to be used to overcome this pressure difference. Only after manual activation of the main power supply signal a compressor pressure needs to be built up. As no intermediate pressure cut back or build up is required, and no overcoming of the pressure difference in front of and after the valves, the cooling system can be equipped with a relatively small and/or inexpensive compressor, for instance having a lower torque, for instance an LBP compressor. This can lead to a more compact and/or less expensive cooling system in the dispensing apparatus which is also relatively rapidly available and consumes relatively little energy, in spite of the fact that double features are utilized, viz. both cooling and heating means. During use, less time is lost to intermediate building up of the pressure by the compressor as the pressure is continuously kept up to level after switching on. In such a manner, for instance, local freezing of drinking water in a drinking water facility is prevented while the risk that no cold fluid can be directly tapped in the mean time is thereby reduced.

The invention is suitable for, inter alia, keeping cool relatively small portions of cooled fluid, in particular beverage, more particularly drinking water, whereby it is not desired to provide the dispensing apparatus continuously with power, as is the case with, for instance, relatively large drinking water cooling apparatuses. In principle, the main power supply will be manually switched on and switched off. The apparatus will consume power only during periods determined by the user, for instance when the apparatus is actually in use, so that relatively little energy is consumed.

While the main power supply is switched on and/or also some time after, cold water can be drawn relatively frequently, for instance every 60 seconds or less a glass of cooled water can be tapped. As relatively small compressors can be utilized and/or as the invention is suitable for relatively small portions of water, the dispensing apparatus can furthermore be designed to be relatively small so that this occupies relatively little space and is suitable for, for instance, use on tables, on counters, in kitchens et cetera. Accordingly, the dispensing apparatus according to the invention is suitable for supplying the main power supply for relatively short periods of time, for instance minutes or a few hours, while, in the interval, the compressor needs not be switched off.

Different means for active heating can be utilized to prevent the fluid from dropping below a particular reference temperature. An active heating element may be deployed for heating the fluid when the temperature of the fluid approaches, for instance, freezing point. In another embodiment, fluid may be actively supplied from a fluid buffer to the fluid holder and/or fluid is circulated, so that fluid that is cooled too much in the fluid holder is replaced and/or replenished with fluid from the buffer.

The object mentioned and other objects can also be achieved with a method for cooled dispensing of a fluid to be drawn, wherein a cooling system is provided which, after manual switching on and until manual switching off of a main power supply, is driven substantially continuously for cooling and/or keeping cool the fluid to be drawn, wherein, owing to the continuous drive, the temperature of at least a part of the fluid to be taken drops, wherein the temperature of the fluid is compared to a reference temperature, and wherein, when this temperature reaches or approaches the reference temperature, the fluid to be drawn, or at least the part mentioned thereof, is actively heated during continuous drive of the cooling system.

BRIEF DESCRIPTION OF THE DRAWINGS

Further advantages and features of the present invention follow from the following description, wherein the invention is described in further detail in several exemplary embodiments on the basis of the appended drawings.

In the drawing.

Figure 1:
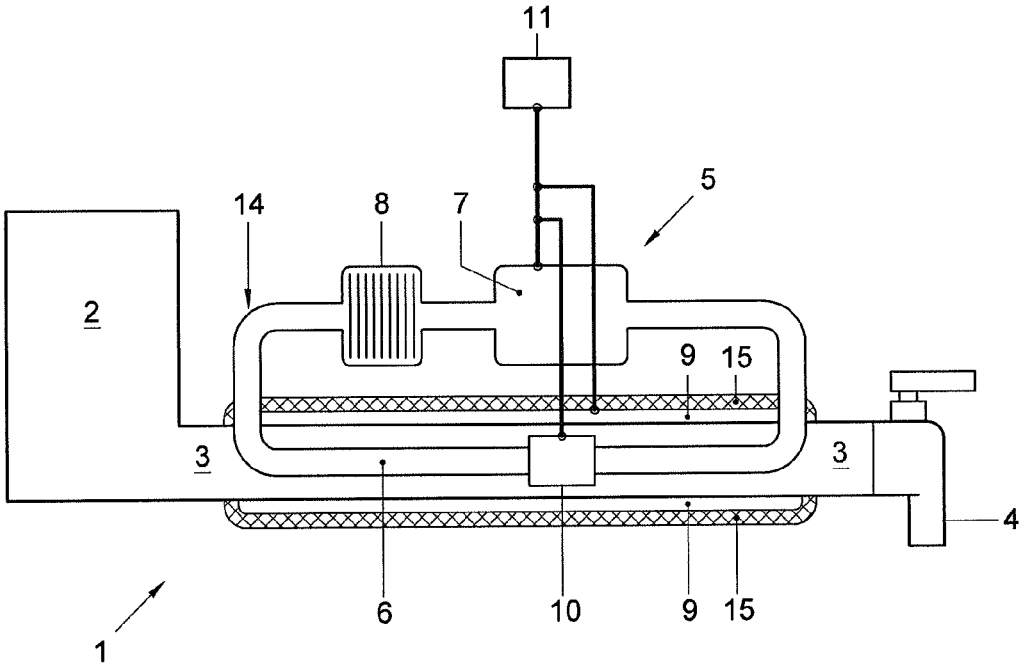
FIG. 1 schematically shows a drinking water facility according to the invention.

In this description, identical or corresponding parts have identical or corresponding reference numerals. In the drawing, embodiments are shown merely by way of example. The elements used there are mentioned merely by way of example and are not construed to be limitative in any manner. Other parts too can be used within the framework of the present invention. The ratios of the embodiments shown in de Figures are typically represented in a schematic and/or exaggerated manner and are not construed to be limitative in any manner.

DETAILED DESCRIPTION

A few principles of an embodiment of a dispensing apparatus according to the invention can be explained on the basis of FIG. 1. FIG. 1 shows an embodiment of a dispensing apparatus according to the invention in the form of a drinking water facility 1 for supplying cooled drinking water. The water is supplied by a water source 2 which is connected to the drinking water facility 1 or forms part thereof. According to different embodiments, suitable water sources 2 can for instance be designed as a buffer, in the form of, for instance, a water bottle, tank or channel, and/or as a connection to water mains. Preferably, the source 2 comprises a water container of approximately 1 liter, at least less than 5 liters and preferably less than 2 liters.

The drinking water facility 1 is provided with a tap 4 for tapping the cooled water. The tap 4 is for instance manually operated. Between the water source 2 and the tap 4, a water holder is provided in the form of a water channel 3. This water channel 3 guides the water from the source 2 along a cooling circuit 5, or at least along a cooling channel 6 thereof, so that the water cools down and the tap 4 supplies cool drinking water. Upon operation of the tap 4, water from the source 2 is guided through the water channel 3 by means of a pump (not shown) or pressure supplied otherwise.

In one embodiment, the coolant circuit 5 according to a known principle comprises, inter alia, a compressor 7, a condenser 8 and a capillary tube 14. When the main power supply of the drinking water facility 1 according to the invention is manually switched on, the cooling circuit 5 is continuously driven and the coolant is circulated in the circuit 5. When relatively small portions of water are used, a relatively weak compressor 7 may suffice, for instance a compressor 7 with a "low back pressure" (LBP), which compressor 7 consumes relatively little energy.

Owing to the continuous drive of the compressor 7, the water is kept cool continuously so that cold water can be tapped relatively continuously and furthermore, the water cools down relatively rapidly.

In order to prevent freezing, at least dropping of the water temperature below a particular reference temperature according to the invention, a drinking water facility 1 according to the invention is provided near the cooling circuit 5 with means for actively heating the water in the water channel 3, without having to switch off the compressor 7. In the embodiment of FIG. 1, these means are designed as a heating element 9. The heating element 9 is for instance designed as a heating resistance and is preferably attached against the water channel 3, near cooling channel 6. In the water channel 3, the water can undergo in situ cooling from the cooling channel 6 and/or heating from the heating element 9. An advantage is that it is not necessary to first cool a water tank and/or buffer in order to tap cool water. Water in the water channel 3 can be cooled relatively rapidly. This will produce gain of time for instance when tapping a first cup of cooled water.

For measuring the temperature and comparing to a reference temperature, near or against, for instance, the water channel 3, a suitable temperature sensor 10 is present, preferably provided with a thermocouple. The sensor 10 is designed having a temperature control circuit for activating the heating element 9 when the temperature of the water, or at least the water channel 3, reaches or approaches the reference temperature. The sensor 10 signals, for instance, when the temperature of the water or the water channel 3 approaches freezing point, for instance if no water has been tapped during a relatively long period of time, while the cooling circuit 5 is continuously driven. Then, during driving of the cooling circuit 5, the sensor 10 activates the heating element 9 so that the water is automatically heated and is prevented from, for instance, freezing or becoming too cold. What is also prevented is that the cooling circuit 5 has to be started over and over again, as is the case with many known systems.

In one embodiment, the drinking water facility 1 is designed to be switched on for a period of time to be determined by the user, wherein, between switching on and switching off, the cooling circuit 5 provides the cooling system continuously with a power supply signal. The compressor 7 is for instance activated upon connection of the plug of the drinking water facility 1 in the socket and is thereupon driven continuously, i.e. at substantially continuous compressor pressure, until the plug is taken from the socket again.

In other embodiments according to the invention with such a continuous power supply signal, an on/off switch may be provided on the drinking water facility 1 with which the main power supply signal is manually switched on and off, while the plug needs not be taken from the socket. In yet another embodiment, the drinking water facility 1 can be switched on manually, whereby the length of the main power supply signal can be preset. By means of, for instance, an operating panel, the cooling system can be digitally set to remain switched on for 30, 60, 90, 120 or other numbers of minutes. This is favourable with respect to the prior art because during relatively short periods of time, a relatively light compressor is put into operation, which is energy favourable. In the meantime, cool water can be frequently tapped.

The embodiments mentioned, with which after switching on, a continuous main power supply is provided, do naturally not preclude that the drinking water facility 1 can have a sort of "stand-by" position wherein power is indeed consumed but the cooling circuit 5, or at least the compressor 7, is switched off. In such a position, in switched off position, a small amount of energy can still be consumed, for instance for running a small clock and/or presetting times for running the cooling circuit 5.

With the drinking water facility 1 in cooling condition, the water will be kept in a suitable manner within a temperature range of approximately 0.5° C. (at least above freezing) to 15° C., preferably between 1° and 5° C., more preferably between 2° and 4°. The temperature sensor 10 is for instance preprogrammed for switching the heating element 9 on when a reference temperature of 2° is reached, and/or for switching off at a reference temperature of approximately 4°. Naturally, other temperature ranges can also be suitable within the framework of the invention, and be dependent on, for instance, the type of use of the invention. The temperature of a part of the water for instance will, on average, drop when the heating element 9 is switched off and, on average, remain equal and/or rise when the heating element 9 is switched on. The temperature of the water to be cooled remaining equal and/or rising can also be achieved passively when the water is manually tapped so that is it replaced and/or replenished with water from the water source 2. Here, the heating element 9 can also be switched off when the drinking water in the water channel 3 is replaced and/or replenished with water from the water source 2.

In one embodiment, as shown in FIG. 1, the cooling channel 6 extends at least partly in the water holder, in this case in a water channel 3. In another case, the water holder comprises, for instance, a buffer, such as a water tank, in which for instance a cooling channel 6 is immersed and/or along which a cooling channel 6 is arranged.

In one embodiment that is preferred, the water channel 3 comprises a tubular channel, with good heat exchanging properties, for instance a copper tube. Other materials too can be suitable, for instance other types of metal and/or plastics, while for instance also advantageous manufacturing properties, such as extrusibility, can play a part. Good heat exchanging properties are advantageous for, for instance, conducting the heat from the heating element 9. The cooling channel 6 is also of tubular design and extends coaxially within the water channel 3. The heat, at least the coolness, of the cooling channel 6 is exchanged with the surrounding water so that the water is cooled relatively efficiently and over the length of the channels 3, 6. Preferably, the cooling channel 6 has good heat exchanging properties and is thereto manufactured from, for instance, copper. Along the water channel 3 at least one heating element 9 extends. The heating element 9 is preferably positioned over its length along both channels 3, 6 against the water channel 3. The heating element 9 can also extend along only a part of the water channel 3. The heating element 9 is for instance designed as heating wire or heating spiral and can be advantageously positioned along at least a part of the length of the water channel 3. Through heating the water channel 23, freezing of the water in the water channel 3 can be prevented at least locally.

Water channel 3, cooling channel 5 and heat element 9 form, for instance, a heat exchanger 13. For keeping the whole cool, for instance insulation 15 is provided around the heat exchanger 13. The temperature sensor 10 is preferably arranged against the outside of the water channel 3 and/or within the insulation 15.

Figure 2A:
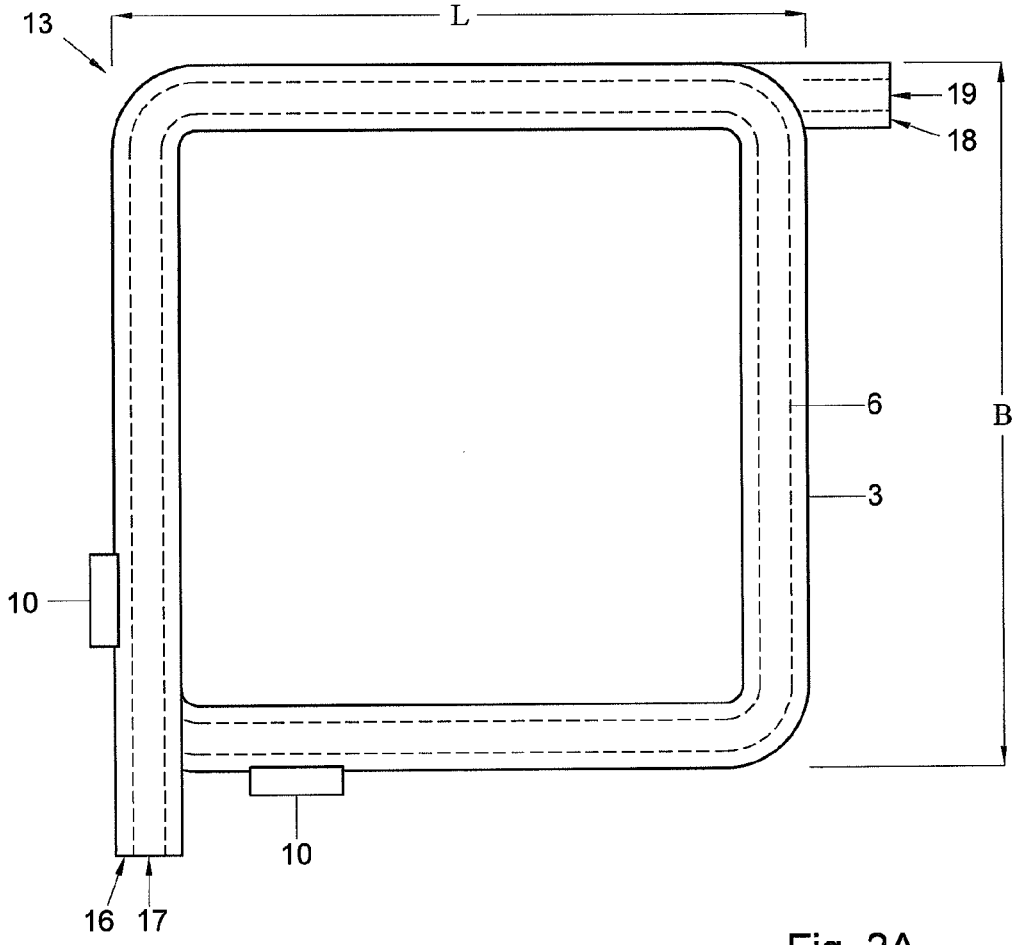
FIGS. 2A and 2B schematically show a heat exchanger according to the invention in top plan view and front view, respectively.
Figure 2B:
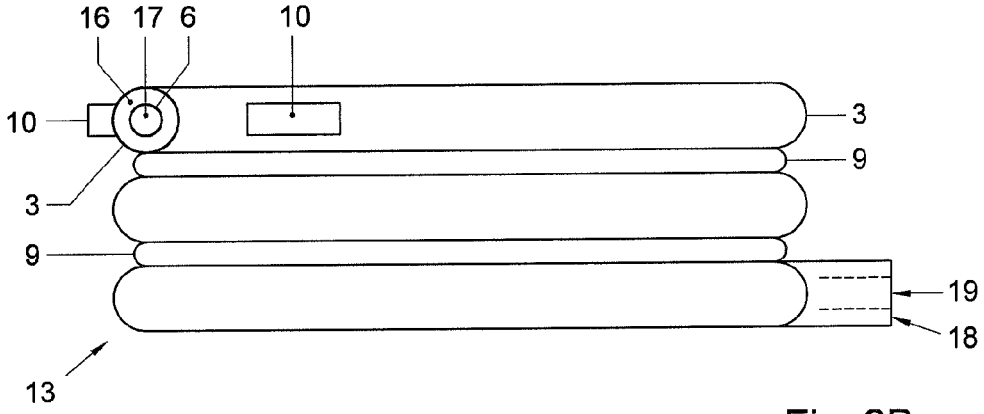

In one embodiment, the heat exchanger 13 is wound, as is shown in, for instance, FIGS. 2A and 2B in top plan view and side view, respectively. Winding the channels 3, 6, allows for the use of relatively long channels 3, 6 and cooling of the water over a long path, while the heat exchanger 13 can remain relatively compact. The channels 3, 6 have a length of, for instance, more than 3 meters, while the length L and/or width B of the wound heat exchanger 13 can remain less than 300 mm, for instance approximately 270 mm. The tubular channels 3, 6 and the heating element 9 are suitably chosen, for instance from copper and heating wire, respectively, to be bend relatively easily and take up a wound form. As can be seen in FIGS. 2A and 2B, at the ends of the channels 3, 6 feeds and drains are provided for feeding and draining water and coolant. At a first end, for instance a water drain 16 and a coolant feed 17 are provided. At the second end, a water feed 18 and a coolant drain 19 are provided. The water drain 16 leads to the tap 4 and the water feed is connected to a water source 2.

In one embodiment, use is made of thin-walled tubes and the water channel 3 preferably comprises a copper tube with an outer diameter of approximately 11.8 mm with a wall thickness of approximately 1.8 mm. The cooling channel 6 is, for instance, a preferably copper tube with an outer diameter of approximately 6 mm and a wall thickness of approximately 1.8 mm, and is axially disposed within the water channel 3. The length of both preferably copper tubes is for instance approximately 3 m. It is preferred that the channels 3, 4, at least the tubes, are as thin-walled as possible.

In one embodiment, the cooling system is designed such that the dispensing apparatus 1, including a water source 2 of, for instance, approximately 1L, the tubular water channels 3, 6 and a compressor 7 take up a space of less than 5 liters. Thus, in a suitable manner, a dispensing apparatus 1 can be provided which is suitable for use on, for instance, a counter or table, for relatively small portions of water, wherein each time amounts of water of between 0.1 and 1 liter are drawn.

A preferred embodiment preferably has channels 3, 6 with smaller wall thicknesses, so that lower thermal capacities can be achieved. A lower thermal capacity and/or a thin-walled channel 3, 6 is favourable for, inter alia, cooling the water relatively rapidly, so that the end user can relatively rapidly tap an amount of cool water. Also after switching on the main power supply, a first cup of water can be tapped relatively rapidly. In addition, also the heating element 9 can effectively conduct heat to the water. It has been calculated that it is favourable if the copper tube of the water channel 3 has an outer diameter of, for instance, 12 mm and a wall thickness of 0.9 mm. The copper tube of the cooling channel 9 has, for instance, an outer diameter of approximately 6 mm and a wall thickness of approximately 0.7 mm. The heating element 9 then comprises, for instance, a wire of approximately 3.3 m and has a heating capacity of, for instance, approximately 300 W at 220V. According to calculations, such an embodiment exhibits favourable heat exchanging properties. Furthermore, the thermal capacity in other embodiments can for instance be further optimized.

The heating element 9 is connected to, for instance, a protection designed for switching off the heating element 9 if it reaches or approaches a particular heating reference temperature. The heating element 9 is for instance switched off at a heating reference temperature of approximately 56° C. After being switched off, the heating element 9 will be cooled automatically by the cooling circuit 5 and will soon and automatically be switched on again when necessary.

It is preferred that the temperature sensor 10, in particular the thermocouple, has a low thermal capacity. This is beneficial to the heat exchanging properties of the heat exchanger 13. The thermocouple can, for instance, be provided against the water channel 3, for instance the copper tube. The thermocouple can for instance be constructed such that a metal housing is not present or is removed, respectively, from around the thermocouple. The sensor 10 is further provided with a temperature control circuit that switches the means for heating 9 on and off. This circuit activates the heating element 9 when a particular minimum temperature is reached or approached and switches it off when a maximum temperature is measured, so that the water is held approximately within a particular cooled temperature range, but does not freeze.

Figure 3:
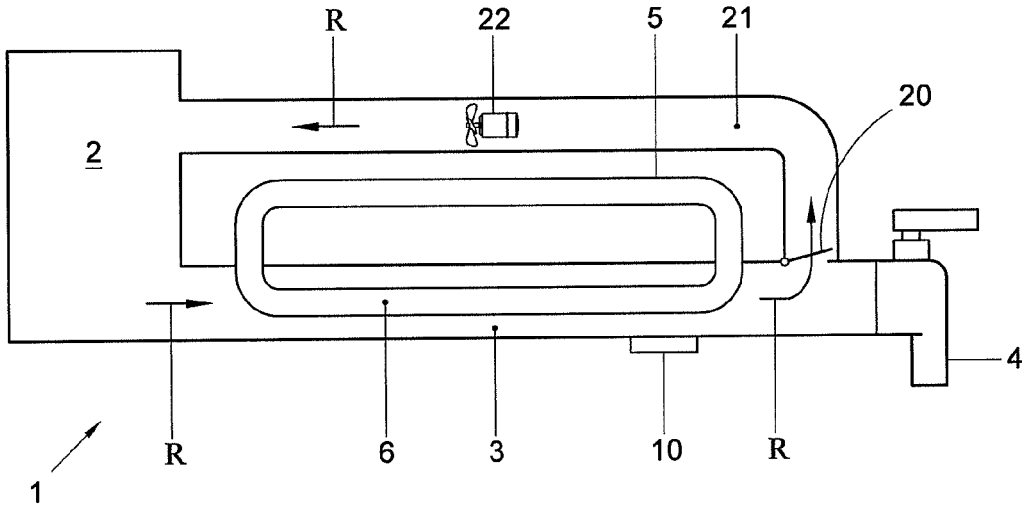
FIG. 3 schematically shows a drinking water facility according to the invention.

In an alternative embodiment, the means for active heating of the drinking water comprise a valve 20 for allowing water from the water source 2 or buffer into the water channel 3. Such an embodiment is schematically illustrated in FIG. 3. Freezing in the water channel 3 can be prevented by automatically replacing water already cooled in the water channel 3 and/or replenishing with water from the water source 2, or at least a water buffer. The water from the water source 2 is relatively warmer than the water cooled by the cooling channel 6 in the water channel 3. The water source 2 is for instance not as well insulated from the surroundings as the water channel 3, or at least the heat exchanger 13, so that the water in the water source 2 will tend to heat up towards an ambient temperature. When the water in the water channel 3 approaches the freezing temperature, this is observed by the sensor 10. The sensor 10 or at least the temperature control circuit drives a valve 20 and, for instance, a pump 22 which allow fresh water to automatically flow from the source 2 into the water channel 3 while for instance cooled water flows towards the source 2, in flow direction R. As the water from the source 2 is hotter than the water in the water channel 3, the temperature of the water in the water channel 3 will rise owing to the automatic supply of the water from the source 2. The use of a valve 20 can make the use of a heating element 9 superfluous. However, the valve 20 and the heating element 9 can also be combined.

According to the same principle designed with, for instance but not expressly, valve 20, the water in the water channel 3 can for instance be replenished with water from a water source 2 or buffer without it being completely replaced. The principle is that the water having a relatively (too) low temperature is replaced and/or replenished with water having a relatively high temperature, so that it does not freeze or at least does not become too cold, in principle independently of the fact whether water is drawn along the tap 4.

Within the framework of the invention, also, uses other than drinking water facilities 1 are conceivable. The invention may for instance be equipped for keeping for instance fruit and/or soft drinks cool. In addition to drinkable fluids, also other, for instance non-drinkable, fluids can be used.

One embodiment according to the invention comprises a dispensing apparatus for cooled drinking water, which has a circumferential volume of, for instance, approximately 5 liters. Naturally, larger or smaller volumes are conceivable too, in the order of, for instance, 5 or 10 liters, or more. This embodiment is provided with a plug for connection to the electricity mains and a main switch for switching the main power supply and, hence, the compressor 7, on and off. Also, a water source 2 in the form of a container is provided, in which container water can be supplied, for instance tap water, or mineral water from a bottle. When the apparatus is switched on by the main switch, a part of the water will be pumped into the water channel 3 and be cooled relatively rapidly. In the case the apparatus 1 is switched on for periods of time of, for instance, a few minutes or hours, during the same period of time, water at a desired cool temperature can be drawn repeatedly by means of the tap, for as long as the supply lasts in the apparatus 1.

The described and many comparable variations, as well as combinations thereof, are understood to fall within the framework of the invention as outlined by the claims. Naturally, different aspects of different embodiments and/or combinations thereof can be combined and exchanged with each other within the framework of the invention. The water and cooling channels 3, 6 can for instance be wound and/or comprise tubes, for instance according to the principle of FIGS. 2A, 2B. Also, different means for heating can be combined, an embodiment according to FIG. 3 can for instance also comprise a heating element 9. Delimitation should therefore not be restricted to only the embodiments mentioned

The invention claimed is:

1. A dispensing apparatus for dispensing cooled potable fluid suitable for consumption, comprising:

a potable fluid holder coupled to a potable fluid channel, a cooling system for the potable fluid channel for cooling potable fluid in the potable fluid channel, wherein the cooling system includes a cooling channel, the cooling channel arranged coaxially within the potable fluid channel, a tap for dispensing potable fluid from the potable fluid channel, a heating system for active heating of potable fluid in said potable fluid channel in order to prevent the temperature of said potable fluid from dropping below a reference temperature; and a temperature sensor configured to sense a temperature of the potable fluid and activate the heating system when the temperature of potable fluid in the potable fluid channel reaches or approaches a particular reference temperature;

wherein the dispensing apparatus is configured for being switched on for a period of time to be determined by a user, and for providing the cooling system, between switching on and switching off, continuously with a power supply signal; and wherein the apparatus is configured so that, in use, the cooling system is driven continuously for continuously cooling potable fluid in the potable fluid channel while the temperature sensor is used to activate the heating system during continuous operation of the cooling system for heating potable fluid in the potable fluid channel when the temperature of the potable fluid reaches a particular reference temperature.

2. A dispensing apparatus according to claim 1, wherein the cooling system is provided with a compressor, and wherein, between said switching on and switching off, the dispensing apparatus is designed for providing the compressor substantially continuously with a power supply signal, so that the compressor is driven continuously.

3. A dispensing apparatus according to claim 1, wherein the heating system comprises a heating element.

4. A dispensing apparatus according to claim 1, wherein the cooling system comprises a cooling channel which extends at least partly within the potable fluid channel for cooling potable fluid in the channel.

5. A dispensing apparatus according to claim 1, wherein the temperature sensor at least partially extends along at least one of the two channels.

6. A dispensing apparatus according to claim 5, wherein the heating system comprises a heating element, which extends along the cooling and potable fluid channels.

7. A dispensing apparatus according to claim 6, wherein the dispensing apparatus is provided with a heating element protection which switches off the heating element if this reaches a heating reference temperature.

8. A dispensing apparatus according to claim 1, further comprising a potable fluid buffer and wherein the heating system comprises a valve for allowing potable fluid from the potable fluid buffer into the potable fluid holder.

9. A dispensing apparatus according to claim 1, wherein the dispensing apparatus relates to a drinking water facility and a tap is provided which is manually operable.

10. A dispensing apparatus according to claim 1, wherein the sensor comprises a thermocouple.

11. A dispensing apparatus operable to provide cooled potable fluid suitable for consumption to users, the dispensing apparatus comprising:

a potable fluid channel comprising both a heating system and a cooling system;

wherein the cooling system is configured to cool potable fluid in the potable fluid channel, and to operate continuously for at least a predetermined time period upon operation of the dispensing apparatus;

wherein the dispensing apparatus is configured for being switched on for a period of time to be determined by the user, and for providing the cooling system, between switching on and switching off, continuously with a power supply signal;

wherein the heating system is configured to selectively heat the potable fluid in the potable fluid channel during continuous operation of the cooling system based on the temperature of the potable fluid in the potable fluid channel decreasing below a predetermined reference temperature; and wherein the cooling system includes a cooling channel, the cooling channel arranged coaxially within the potable fluid channel.

12. The dispensing apparatus of claim 11, wherein the cooling system operates continuously for the duration of operation of the dispensing apparatus.

13. The dispensing apparatus of claim 12, wherein the cooling system comprises a compressor, the compressor operating continuously for the duration of operation of the dispensing apparatus.

14. The dispensing apparatus of claim 1, wherein the heating system includes a heating element in contact with an exterior of the potable fluid channel.

* * * * *